US005425403A

United States Patent [19]

Herrmann

[11] Patent Number: 5,425,403

[45] Date of Patent: Jun. 20, 1995

[54] DEVICE FOR FILLING BAGS WITH A POWDER-LIKE OR GRANULAR FLOWABLE MATERIAL, ESPECIALLY SAND

[76] Inventor: Otto Herrmann, Zellerstr. 5, 77781 Biberach, Germany

[21] Appl. No.: 126,529

[22] Filed: Sep. 24, 1993

[51] Int. Cl.[6] ..... B65B 1/12

[52] U.S. Cl. ..... 141/314; 141/313; 141/67; 141/114; 141/256; 141/72; 141/351; 141/362; 361/190

[58] Field of Search ..... 141/10, 68, 72, 76, 141/256, 313–315, 317, 351, 353–355, 359–362, 67, 114; 361/189, 190

[56] References Cited

U.S. PATENT DOCUMENTS

| | | | |
|---|---|---|---|
| 1,696,952 | 1/1929 | Hartman | 141/360 X |
| 2,052,996 | 9/1936 | WItte | 141/361 X |
| 2,309,246 | 1/1943 | Henry | 141/361 |
| 3,093,271 | 6/1963 | Douglas | 141/68 X |
| 3,552,346 | 1/1971 | Garden | 141/72 |
| 3,560,800 | 2/1971 | Weidenfeld | 361/189 |
| 3,867,970 | 2/1975 | Winchester, Sr. | 141/67 |
| 3,867,979 | 2/1975 | Winchester, Sr. | 141/67 |
| 3,914,621 | 10/1975 | Passarelli, Jr. | 361/189 X |
| 3,916,963 | 11/1975 | McIntosh | 141/361 X |
| 4,164,244 | 8/1979 | Meier | 141/256 X |
| 4,248,276 | 2/1981 | Gosnell | 141/362 X |
| 4,412,268 | 10/1983 | Dassow | 361/189 X |
| 4,763,702 | 8/1988 | High, Jr. et al. | 141/114 |
| 4,942,983 | 7/1990 | Bradbury | 141/360 X |

FOREIGN PATENT DOCUMENTS

| | | |
|---|---|---|
| 927012 | 7/1949 | Germany . |
| 1230711 | 11/1961 | Germany . |
| 1486047 | 2/1969 | Germany . |
| 2740178 | 4/1978 | Germany . |
| 3441409 | 5/1986 | Germany . |
| 3520492 | 12/1986 | Germany . |

*Primary Examiner*—J. Casimer Jacyna
*Attorney, Agent, or Firm*—Robert W. Becker & Associates

[57] ABSTRACT

A device for filling bags with a flowable material has a hopper with a bottom portion for receiving the flowable material. A filling socket is connected to the bottom portion of the hopper and has a vertically downwardly extending receiving section for receiving a bag to be filled. A worm conveyor is horizontally mounted within the bottom portion of the hopper and connected to the filling socket for conveying the flowable material from the hopper to the filling socket. An electric motor is drivingly connected to the worm conveyor. A switch positioned in the vicinity of the receiving section is activated upon slipping a bag to be filled over the receiving section to start the electric motor for the worm conveyor and the switch is deactivated upon removal of the bag after filling to stop the electric motor.

10 Claims, 4 Drawing Sheets

DEVICE FOR FILLING BAGS WITH A POWDER-LIKE OR GRANULAR FLOWABLE MATERIAL, ESPECIALLY SAND

BACKGROUND OF THE INVENTION

The present invention relates to a device for filling bags with a powder-like or granular flowable material, especially sand, having an especially funnel-shaped hopper for the flowable material with a bottom portion that has connected thereto a horizontal worm conveyor driven by an electric motor as well as a filling socket extending from an end face of the hopper and being angled vertically downwardly. The worm conveyor opens into the filling socket onto which the bag to be filled is slidable, whereby within the receiving area of the filling socket for the bag to be filled a switch is arranged which, upon sliding the bag onto the filling socket, is actuated and activates the filling process.

A particular field of application of the inventive filling device is the filling of sand bags. Such sand bags are, for example, used for building a dam in flood situations. However, the inventive filling device is also suitable for other flowable materials, in particular powder-like or granular flowable materials.

From U.S. Pat. No. 3,867,970 a device for mixing two materials, especially cement and sand, and the subsequent filling into respective containers are known. For this purpose, hoppers for the materials to be mixed are provided which are closed by flaps that can be activated by a piston-cylinder unit. The two hoppers open at their bottom portion into a worm conveyor. The worm conveyor opens into a vertically downwardly angled filling socket onto which the bags to be filled are to be slipped. This filling socket, in the receiving area for the bag to be filled, is provided with a bag clamping device which is in operative connection with a switch. This switch, in turn, is in operative connection with an electromagnetic valve for the piston/cylinder unit. After adjustment of the correct ratio of the materials to be mixed the worm conveyor is switched to permanent operation. By slipping a bag to be filled onto the filling socket the bag clamping device activates the switch and the switch operates the electromagnetic valve which, via the piston/cylinder unit, pivots the flaps so that the materials contained in the hoppers are conveyed into the worm conveyor and are mixed therein. During mixing the materials are simultaneously moved towards the filling socket and are conveyed into the bag. After removal of the bag the flaps are closed and the filling process is terminated.

Based on this prior art device, it is an object of the present invention to provide a filling device of the aforementioned kind that is easy to manipulate and that also provides for a high filling capacity.

SUMMARY OF THE INVENTION

The inventive device for filling bags with a flowable material according to the present invention is primarily characterized by:

A hopper with a bottom portion for receiving the flowable material;

A filling socket connected to the bottom portion of the hopper, the filling socket having a vertically downwardly extending receiving section for receiving a bag to be filled;

A worm conveyor horizontally mounted within the bottom portion of the hopper and connected to the filling socket for conveying the flowable material from the hopper to the filling socket;

An electric motor drivingly connected to the worm conveyor; and

A switch positioned in the vicinity of the receiving section, the switch being activated upon slipping a bag to be filled over the receiving section to start the electrical motor for the worm conveyor and the switch being deactivated upon removal of a bag after filling to stop the electric motor.

Preferably, the hopper is funnel-shaped.

The filling socket further comprises a cylindrical section extending horizontally from the bottom portion, with the worm conveyor extending into the cylindrical section, wherein the receiving section is cylindrical and connected to the mantle of the cylindrical section.

Preferably, the cylindrical section has an end face and the worm conveyor comprises a shaft that is freely rotatable supported in the end face of the cylindrical section.

The worm conveyor, over an entire axial length thereof has preferably a uniform diameter.

The device expediently further comprises a supporting grate positioned under the filling socket for supporting a bag during filling.

The device also comprises an actuating element connected to the filling socket, the actuating element operatively connected to the switch and activated manually by an operator.

Preferably, the actuating element is comprised of two actuating members and the switch is comprised of two switch elements. Each actuating member is operatively connected to one of the switching elements, wherein each actuating member is activated by one hand of the operator, respectively, and wherein the electric motor is activated only when the two actuating members are simultaneously activated by both hands of the operator. Each actuating member is expediently a lever that is pivotable about a horizontal axis A.

Preferably, the actuating element is a horseshoe-shaped lever connected with an open base thereof to the receiving socket so as to be pivotable about a horizontal axis A and to surround the receiving socket.

Expediently, the hopper further comprises a vibrating device. The hopper also may comprise a cover in the form of a cover grate. Preferably, the hopper has a detachable extension.

In a preferred embodiment of the present invention the device is designed at a periphery thereof such that a plurality of such devices are connectable to one another so as to form, in a top view, a closed receiving surface, comprised of adjacent ones of the hoppers, for the flowable material.

With the present invention a filling device, especially for sandbags, is provided which, on the one hand, is easy to manipulate and, on the other hand, operates at a high filling capacity. This is inventively achieved such that the opening of the bag is slipped in upward direction onto the vertically downwardly extending filling socket. During the process of slipping the bag onto the filling socket the switch is simultaneously activated which starts the electric motor for the worm conveyor. This activation of the switch can be achieved by the upper edge of the bag and/or by the hand of the operator. Accordingly, as soon as the bag to be filled has reached its filling position on the filling socket, the filling operation is started. After the bag has been filled with the predetermined amount of flowable material, the bag is removed downwardly from the filling socket. At the same time the switch is returned into its rest position in which the electric motor for the worm conveyor is stopped so that a further conveying of the flowable material is interrupted. Only when the next empty bag is slipped onto the filling socket, the worm conveyor is again started and the new bag is filled.

In a further embodiment of the inventive filling device it is suggested that a first horizontally extending cylindrical section is provided into which the end of the worm conveyor extends. To the mantle surface of this first cylindrical section a second cylindrical receiving section extending vertically downwardly is connected. This provides a technically simple design of a filling socket whereby conventional components can be used. After passing through the first cylindrical section the flowable material conveyed by the worm conveyor flows downwardly into the second receiving section and into the bag to be filled. Of course, it is also conceivable that the two cylindrical sections of the filling socket are connected to one another at an angle with a miter joint.

In another embodiment of the present invention, it is suggested that at an end face of the first cylindrical section the shaft of the worm conveyor is freely rotatably supported. This provides for a technically simple solution for the bearing of the worm conveyor wherein the first cylindrical section has a rotational bearing at its end face.

In another embodiment of the present invention, the worm conveyor has a uniform diameter over its entire length. This ensures that the flowable material can be conveyed into the filling socket without complications, for example, without compressing the flowable material which could result in clogging of the worm conveyor.

It is also suggested with the present invention that below the filling socket a supporting grate for supporting the bags to be filled is provided. This has the advantage that during the entire filling process the operator must not support the bag and that instead the operator is relieved from carrying the weight. The supporting grate is preferably pivotable into a vertically upright position when not in use so that the filling device can be transported without problems from one site to another. In a further embodiment it is suggested that the supporting grate is, for example, height-adjustable with a respective plug-in mechanism so that it can be adjusted to varying bag heights.

In a preferred embodiment of the present invention, the filling socket has an actuating element connected thereto that is activatable by the hand of the operator and which is in operative connection with the switch. Upon slipping the bag to be filled onto the receiving section of the filling socket, the actuating element is activated either by the upper edge of the bag and/or by the hand of the operator so that the actuating element in turn activates the switch and thus starts the worm conveyor. After the filling process of the bag is completed and the bag has been removed from the receiving section, the actuating element returns into its rest position and the switch interrupts the operation of the worm conveyor.

It is furthermore suggested that the filling section is provided with an actuating element comprising two actuating members that are in operative connection with switching elements of the switch whereby the two actuating members each are to be activated by one hand of the operator so that the electric motor for the worm conveyor can only be started when both actuating members are simultaneously activated by both hands. The basic principle of this development including two actuating members is that the operator must use both hands in order to start the electric motor and the worm conveyor upon slipping the bag onto the receiving section. Each of the two actuating members thus activates by itself one electric switching element whereby these two electric switching elements are serially connected (AND circuit). Since the worm conveyor can only be activated with both hands, the operator is thus prevented from extending one hand into the receiving section of the filling socket which could result in injury. This inventive measure thus increases the operational safety of the filling device.

Preferably, the actuating element or the actuating members are in the form of pivotable levers. This is a technically simple design for activating the switch, respectively, both switching elements. The lever which is pivotable about a horizontal axis is upwardly pivoted upon slipping the bag onto the filling socket so that the switch or switching element is activated and the worm conveyor is started. When after completion of the filling step the bag is removed from the filling socket, the lever returns into its rest position and thus interrupts the conveying process. The return of the lever can be achieved by gravity or by biasing the switch with a spring such that the switch acts downwardly on the lever.

In a preferred embodiment it is suggested that the actuating element is in the form of a horseshoe-shaped lever which surrounds the filling socket and which is with its base pivotably connected to the filling socket. This embodiment of the actuating element has the advantage that the filling socket is surrounded substantially about its entire circumference by an activating element in the form of the horseshoe-shaped lever for activating the switch so that upon slipping the bag to be filled over the filling socket the switch is activated in almost any position.

According to another embodiment of the present invention, the hopper is provided with a vibrating device. This has the advantage that it is possible to convey wet sands since the vibrating device ensures that the sand is transported into the bottom portion of the hopper and is thus conveyed into the worm conveyor.

In another embodiment of the present invention the hopper is covered by a cover grate. This prevents that during filling of the hopper stones can enter the hopper which would result in operational problems. For example, this sieve type cover grate can be pivoted upwardly so that the interior of the hopper is freely accessible. In this case, the upwardly pivoted cover grate is in operative connection with a switch so that, upon pivoting of the cover grate, the electric motor is turned off in order to reduce the risk of injury. It is also conceivable that the cover grate is fixedly connected to the hopper so that it cannot be removed accidentally. For example, the sieve-type cover grate can be screwed to the hopper.

It is furthermore suggested with the present invention to provide the hopper with an extension. This extension is preferably a detachable container and serves to increase the volume of the hopper, for example, for an automated filling with a dredger or bucket loader. When the hopper is provided with such an extension, the sieve-type cover grate is no longer connected to the hopper itself, but to the extension. In order to transmit the vibrational energy in an optimal fashion to the extension, it is preferred that the vibrating device is fixedly connected to the hopper, for example, by screwing.

It is also suggested that the inventive filling device is designed about its periphery such that a plurality of such inventive filling devices can be arranged flush adjacent to one another in order to provide a closed receiving surface for the flowable material. The individual filling devices can thus be arranged in a module type design to form larger units. This is advantageous because a series of such filling devices can be simultaneously filled with a bucket loader which improves the operation of the inventive filling devices since simultaneously a plurality of such filling devices can be operated with a high through-put.

BRIEF DESCRIPTION OF THE DRAWINGS

This object, and other objects and advantages of the present invention, will appear more clearly from the following specification in conjunction with the accompanying drawings, in which.

DESCRIPTION OF PREFERRED EMBODIMENTS

Figure 1:
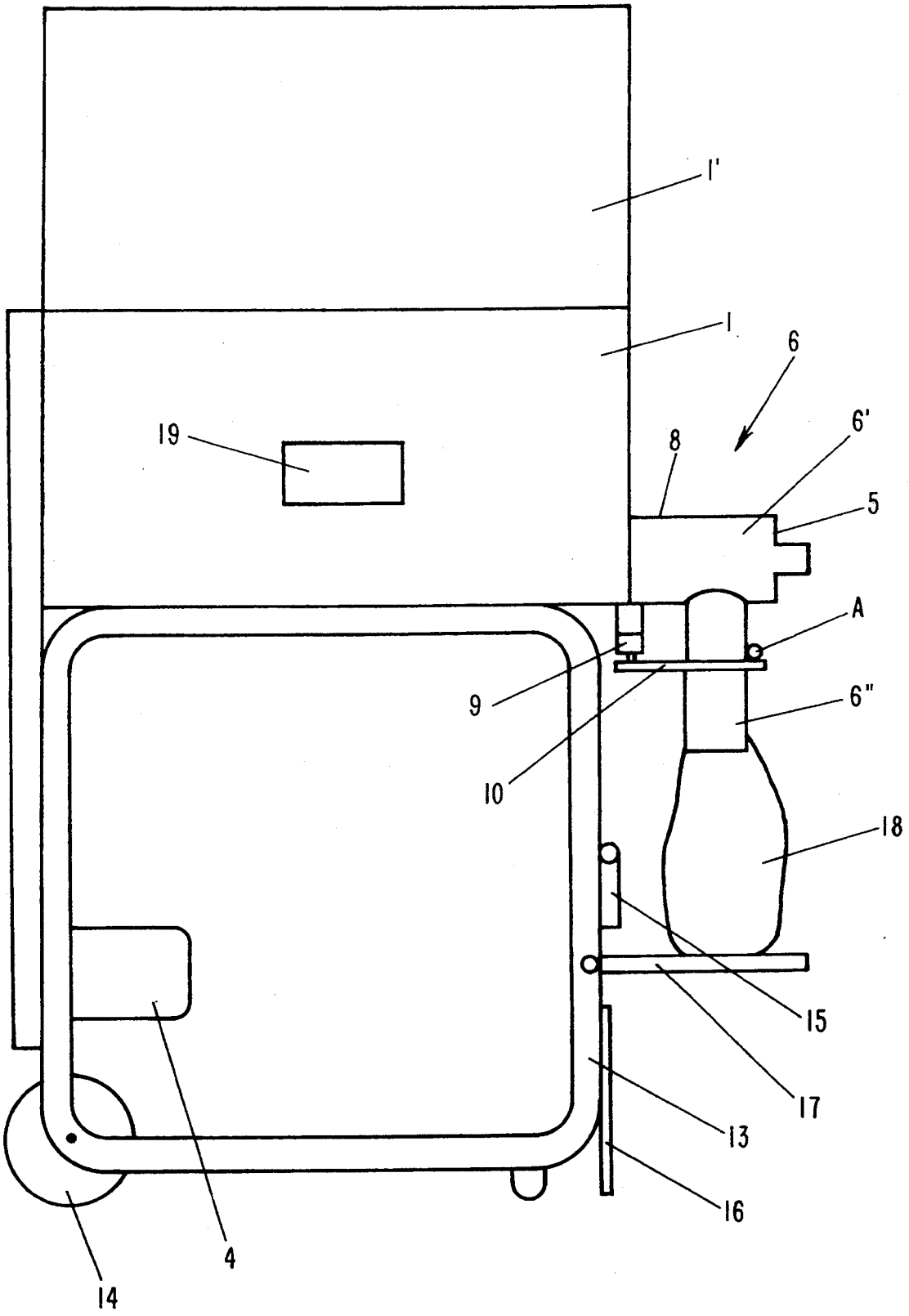
FIG. 1 shows a side view of the inventive device.
Figure 2:
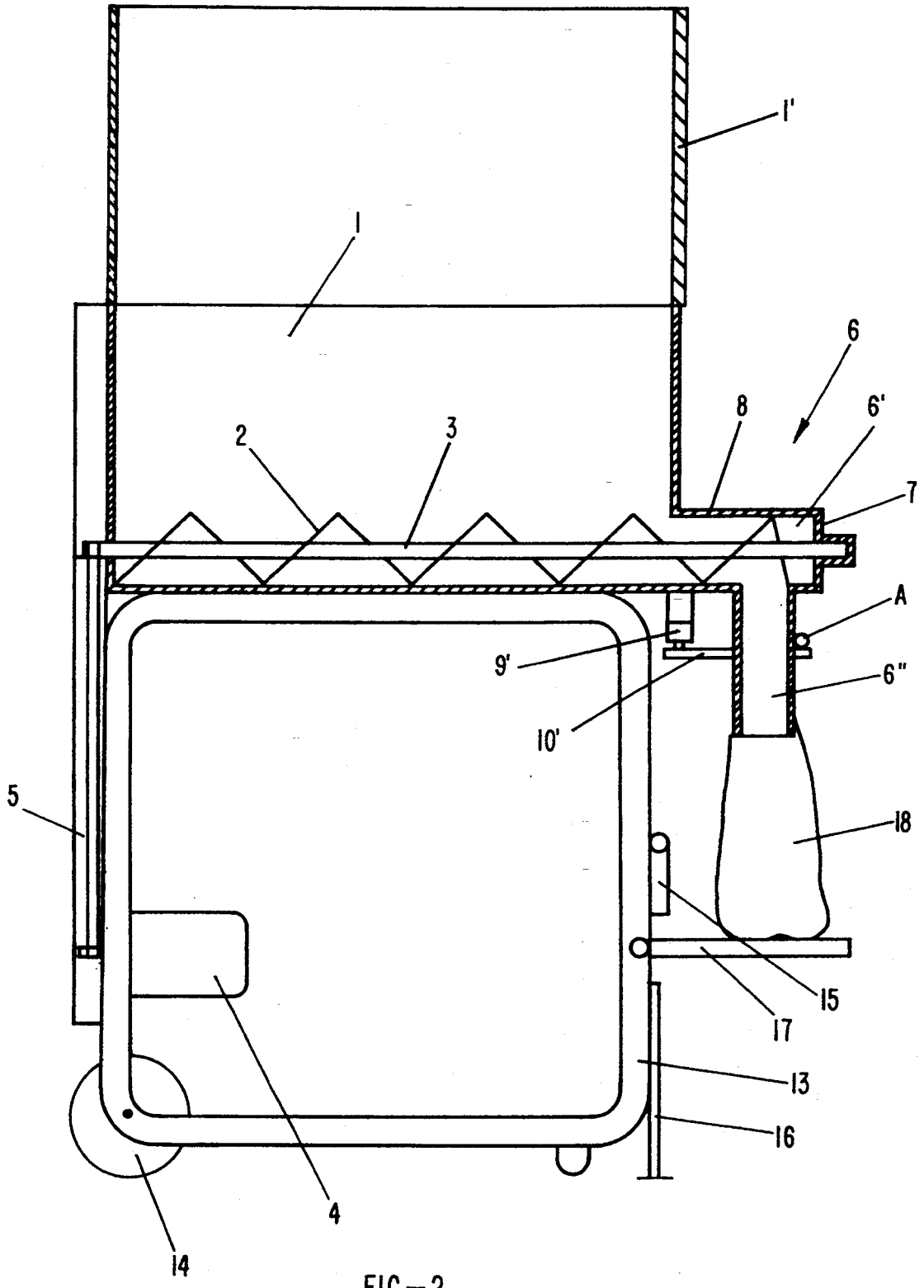
FIG. 2 shows a longitudinal section of the filling device according to FIG. 1.
Figure 3:
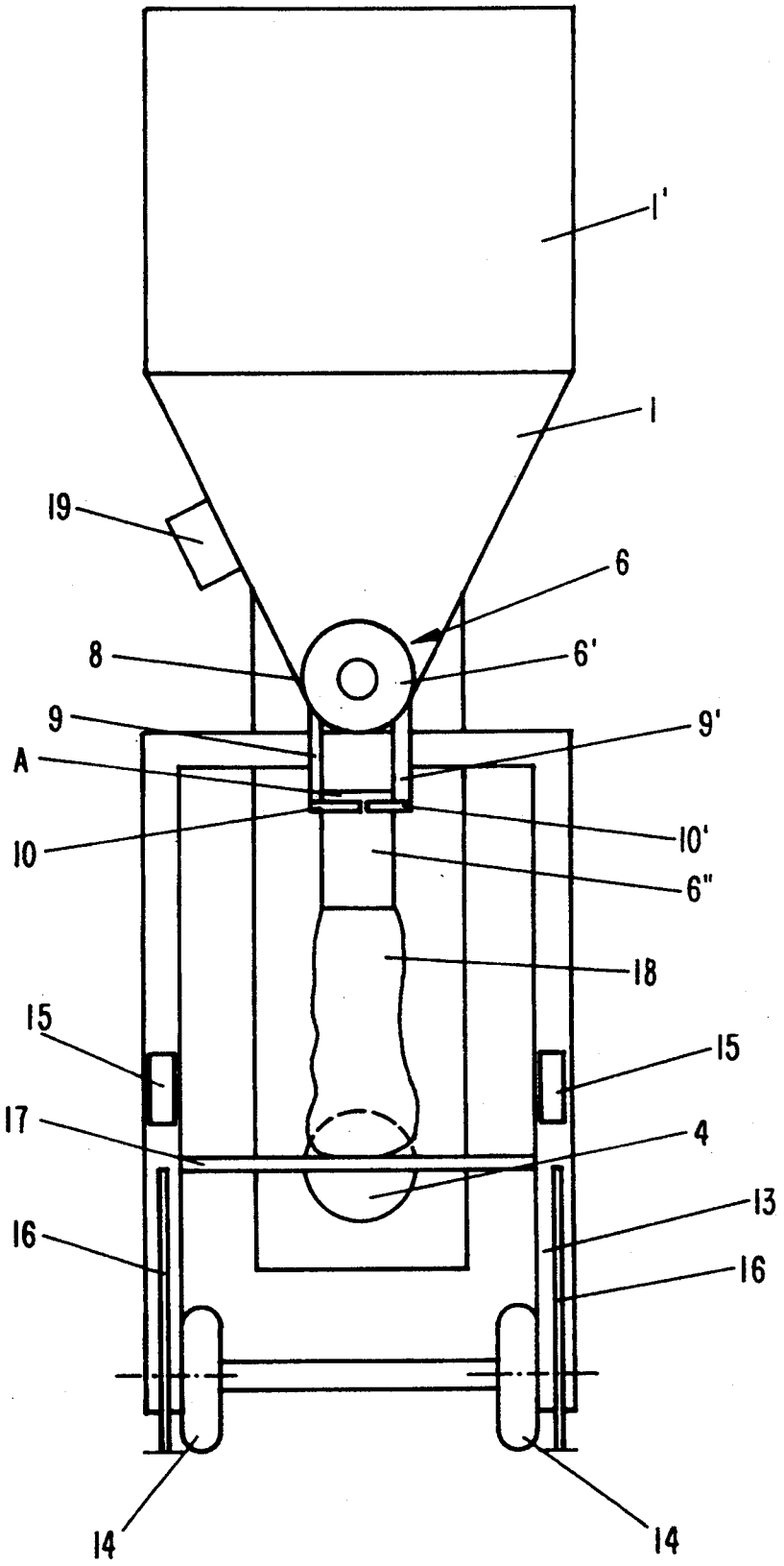
FIG. 3 shows an end view of the filling device of FIG. 1.

The present invention will now be described in detail with the aid of several specific embodiments utilizing FIGS. 1 through 4.

The filling device is provided with a funnel shaped hopper 1 of a V-shaped cross-section. On top of the hopper 1 an extension 1′ is placed and fixedly connected to the hopper 1, for example, by screwing.

At the bottom portion of the hopper 1 a worm conveyor 2 extends in the longitudinal direction along the line of convergence. The worm conveyor is connected with its shaft 3 in a rotatable manner to an end face of the hopper 1. An electric motor 4 drives the worm conveyor 2 via a belt 5 driving the shaft 3.

With its other end the worm conveyor 2 extends into the filling socket 6 which is connected to the other end face of the hopper 1 within the bottom portion. The filling socket 6 is comprised of a first cylindrical section 6′ that extends horizontally from the hopper 1. The end face 7 of this first cylindrical section 6′ receives the shaft 3 of the worm conveyor 2 in a rotatable manner. A second cylindrical receiving section 6″ is connected to the mantle 8 of the first cylindrical section 6′ and extends vertically downwardly and is open at the bottom. The filling socket 6 is thus of an angular design by having the two sections 6′, 6″ connected to one another at a 90° angle.

Two switching elements 9, 9′ of a switch are connected to the hopper 1 in the area of the filling socket 6 to either side of the socket. The switching elements 9, 9′ are in operational connection with two actuating members (levers) 10, 10′ which are pivotable about a horizontal axis A and connected to the second receiving section 6″. The free legs of the actuating levers 10, 10′ are positioned below the switching elements 9, 9′. Instead, it is also conceivable to provide only a single switch which is in operational connection with a horseshoe-shaped actuating lever which with its open end is pivotably connected about a horizontal axis A to the second receiving section 6″ such that the horseshoe-shaped actuating lever surrounds the second receiving section 6″ whereby one of the legs of the actuating lever is positioned below the respective switch.

The top of the extension 1′ is covered by a sieve-type cover grate 11 which is upwardly pivotable and in this position is in operational connection with a switch 12. Instead of providing a pivotable cover grate 11, it is also possible to have the cover grate fixedly connected to the extension 1′, respectively, when the extension 1′ is missing, to the hopper 1.

The hopper 1 with all its mentioned auxiliary devices is mounted on a frame 13. The frame 13 has rollers 14 at one end. The other end has handles or grips 15 which are foldable in an upward direction. Furthermore, the frame 13 in the area of the handles 15 is provided with height-adjustable supports 16 which allow for an adaptation to uneven ground. Also, with the height-adjustable supports 16 the operating height for the operator for placing the bags to be filled can be adjusted. The frame 13, below the filling socket 6, is provided with a supporting grate 17 which, when the device is not in use, can be upwardly pivoted. Furthermore, the grate 17 is height-adjustable so that an easy adaptation to varying bag heights is possible.

The filling device functions as follows:

Initially, the inventive filling device can be moved in a simple manner by hand to the desired operating location by pivoting the handles 15 upwardly so that the operator can lift the filling device and move it with the aid of the rollers 14. At the operating location the supports 16 are correctly positioned, if needed, to increase the stability of the device and the supporting grate 17 is pivoted downwardly and adjusted in its height to the respective size of the bags to be filled. The cover grate 11 is also in its downward position. Subsequently, the flowable material, especially sand, is filled into the hopper 1 with its extension 1′ through the cover grate 11 whereby the cover grate 11 removes large stone by preventing passage through the mesh of the cover grate 11. The hopper 1, respectively, the extension 1′, can be filled to its upper edge with flowable material.

The bag 18 to be filled is now slipped upwardly onto the second receiving section 6″ of the filling socket 6 and is supported on the supporting grate 17. During slipping the bag 18 onto the second receiving section 6″, the two actuating levers 10, 10′ are pivoted upwardly by the hands of the operator such that the two switching elements 9, 9′ are actuated. Only when both switching elements 9, 9′ are actuated, the electric motor 4 and thus the worm conveyor 2 can be started so that the flowable material is transported within the hopper 1 and the worm conveyor 2 to the filling socket 6. The flowable material falls downwardly through the vertically downwardly extending second receiving section 6″ into the bag 18 so that the bag is slowly filled. As soon as the bag 18 has received the desired amount of flowable material, the operator removes the bag 18 from the second receiving section 6″ in a downward direction so that the actuating levers 10, 10′ are also pivoted in a downward direction, be it due to gravity and/or due to a spring bias of the switching elements 9, 9′. The switching elements 9, 9′ are no longer in their active position so that the electric motor 4 is stopped and no further conveying of the flowable material occurs. Because both hands are needed in order to activate the electric motor, it is prevented that the operator could extend one hand into the second receiving section 6″. Accordingly, the risk of injury is greatly reduced.

As described above, the cover grate 11 is in operational connection with a switch 12 such that, upon pivoting upwardly the cover grate 11, the electric motor 4 and thus driving of the worm conveyor 2 are interrupted in order to reduce thereby the risk of injury present, for example, when a person extends their hand into the hopper 1, respectively, the extension 1′, while the worm conveyor 2 is still in operation.

In the case that wet sands are to be processed, the hopper 1 is provided with a laterally positioned vibrating device 19. Due to the vibrations generated by the vibrating device the sand is constantly moved within the hopper 1 so that no clogging within the hopper 1 can occur.

Figure 4:
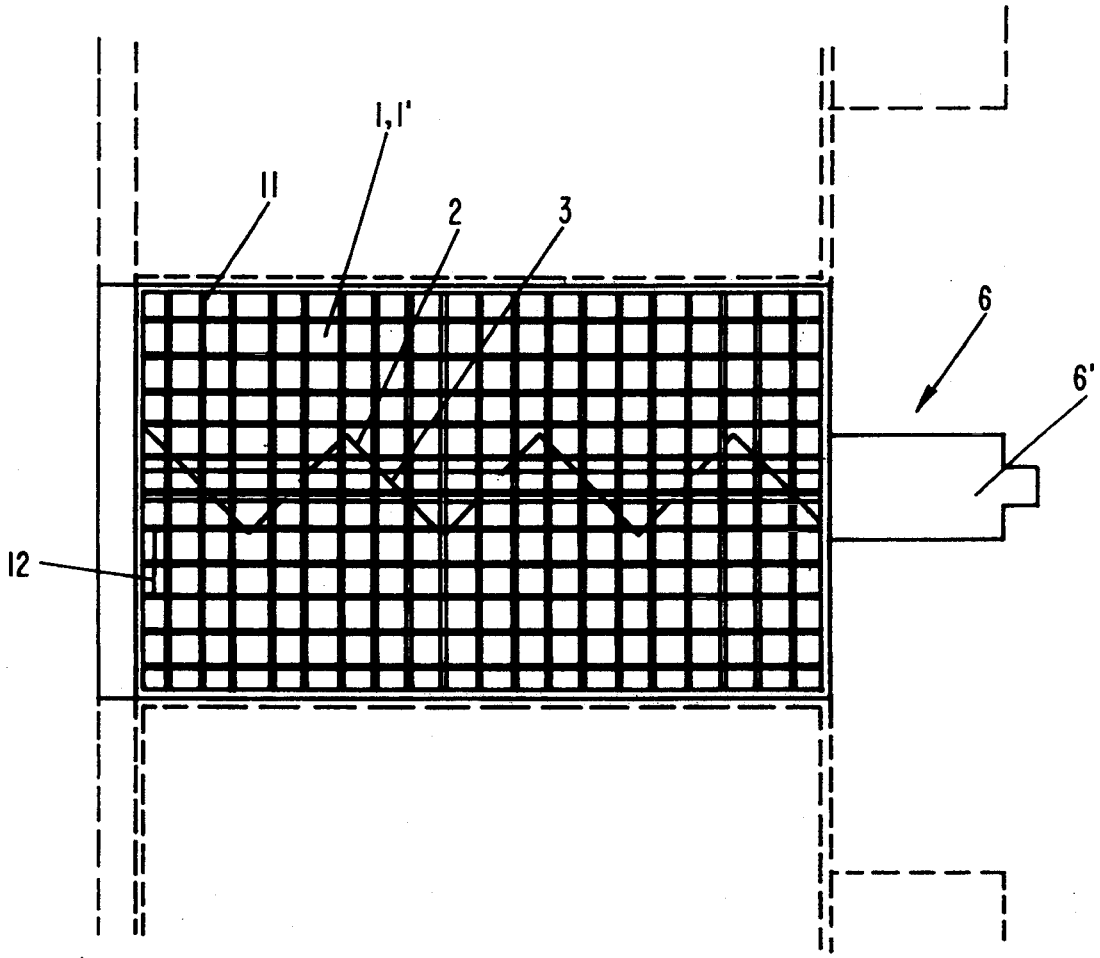
FIG. 4 shows a plan view of the filling device according to FIG.

In FIG. 4 it is shown in dashed lines that a plurality of the inventive filling devices can be arranged adjacent to one another whereby their sides are in a flush arrangement. Accordingly, a plurality of filling devices can be assembled to form a greater unit which has the advantage that this unit can be filled with a single bucket load of a dredger etc.

The present invention is, of course, in no way restricted to the specific disclosure of the specification and drawings, but also encompasses any modifications within the scope of the appended claims.

What I claim is:

1. A device for filling bags with a flowable material, said device comprising:

a hopper with a bottom portion for receiving the flowable material;

a filling socket connected to said bottom portion of said hopper, said filling socket having a vertically downwardly extending receiving section for receiving a bag to be filled;

a worm conveyor horizontally mounted within said bottom portion of said hopper and connected to said filling socket for conveying the flowable material from said hopper to said filling socket;

an electric motor drivingly connected to said worm conveyor;

a first and a second switching elements positioned in the vicinity an electric motor drivingly connected to said worm conveyor;

a first and a second switching elements positioned in the vicinity of said receiving section so as to be activated upon slipping a bag to be filled over said receiving section to start said electric motor for said worm conveyor and deactivated upon removal of a bag after filling to stop said electric motor;

a first and a second actuating lever connected to opposite sides of said filling socket so as to be pivotable about a horizontal pivot axis, wherein said first actuating lever is operatively connected to said first switching element and said second actuating lever is operatively connected to said second switching element;

wherein said electric motor is activated only when said first actuating lever is pivoted upwardly by one hand of the operator and said second actuating lever is simultaneously pivoted upwardly by the other hand of the operator upon slipping a bag onto said filling socket thereby activating said first and second switching elements simultaneously.

2. A device according to claim 1, wherein said hopper is funnel-shaped.

3. A device according to claim 1, wherein said filling socket further comprises a cylindrical section extending horizontally from said bottom portion, with said worm conveyor extending into said cylindrical section, and wherein said receiving section is cylindrical and is connected to a mantle of said cylindrical section.

4. A device according to claim 3, wherein said cylindrical section has an end face and said worm conveyor comprises a shaft, said shaft being freely rotatably supported in said end face of said cylindrical section.

5. A device according to claim 1, wherein said worm conveyor, over an entire axial length thereof, has a uniform diameter.

6. A device according to claim 1, further comprising a supporting grate positioned under said filling socket for supporting a bag during filling.

7. A device according to claim 1 wherein said hopper comprises a vibrating device.

8. A device according to claim 1 wherein said hopper comprises a cover in the form of a cover grate.

9. A device according to claim 1, wherein said hopper has a detachable extension.

10. A device according to claim 1, designed at a periphery thereof such that a plurality of said devices are connectable to one another so as to form, in a top view, a closed receiving surface, comprised of adjacent said hoppers, for the flowable material.

* * * * *